US008595941B2

(12) United States Patent
Lee

(10) Patent No.: US 8,595,941 B2
(45) Date of Patent: Dec. 3, 2013

(54) ASSISTED-OPENING KNIFE

(75) Inventor: Ming-Tsan Lee, Lujhou (TW)

(73) Assignee: Taylor Brands, LLC, Kingsport, TN (US)

( * ) Notice: Subject to any disclaimer, the term of this patent is extended or adjusted under 35 U.S.C. 154(b) by 407 days.

(21) Appl. No.: 12/915,109

(22) Filed: Oct. 29, 2010

(65) Prior Publication Data

US 2012/0102758 A1 May 3, 2012

(51) Int. Cl.
*B26B 3/06* (2006.01)

(52) U.S. Cl.
USPC ..... 30/151; 30/162; 30/338; 30/339

(58) Field of Classification Search
USPC ..... 30/162–164, 329, 339, 151, 338
See application file for complete search history.

(56) References Cited

U.S. PATENT DOCUMENTS

| | | | | |
|---|---|---|---|---|
| 7,533,467 | B2 * | 5/2009 | Fossella | 30/162 |
| 7,562,455 | B2 * | 7/2009 | McHenry et al. | 30/162 |
| 7,574,804 | B2 * | 8/2009 | Bezold et al. | 30/162 |
| 7,596,868 | B2 * | 10/2009 | Berns | 30/162 |
| 7,596,869 | B2 * | 10/2009 | Berns | 30/162 |
| 7,647,702 | B2 * | 1/2010 | Polei | 30/162 |
| 7,765,701 | B2 * | 8/2010 | Okada | 30/162 |
| 7,797,838 | B2 * | 9/2010 | Chu | 30/162 |
| 8,156,653 | B2 * | 4/2012 | Austria et al. | 30/162 |
| 8,205,340 | B2 * | 6/2012 | Austria et al. | 30/162 |
| 2006/0130340 | A1 * | 6/2006 | Berns | 30/162 |
| 2007/0175045 | A1 * | 8/2007 | McHenry et al. | 30/162 |
| 2007/0277382 | A1 * | 12/2007 | Okada | 30/162 |
| 2008/0086896 | A1 * | 4/2008 | McHenry et al. | 30/162 |
| 2008/0222897 | A1 * | 9/2008 | Marfione et al. | 30/162 |
| 2009/0106983 | A1 * | 4/2009 | Berns | 30/162 |
| 2009/0235534 | A1 * | 9/2009 | Chu | 30/162 |
| 2010/0088901 | A1 * | 4/2010 | Glancey et al. | 30/162 |
| 2011/0283543 | A1 * | 11/2011 | Wu | 30/162 |
| 2011/0302787 | A1 * | 12/2011 | Rohrbach | 30/162 |
| 2012/0198703 | A1 * | 8/2012 | Ranieri et al. | 30/162 |
| 2012/0216412 | A1 * | 8/2012 | Chung et al. | 30/143 |

* cited by examiner

*Primary Examiner* — Omar Flores Sanchez
(74) *Attorney, Agent, or Firm* — Luedeka Neely Group, PC

(57) ABSTRACT

An assisted-opening knife has a spring tied to a front of a blade carrier and a movable slider assembly within a slot formed through the blade carrier, so that a blade can be rapidly extended by the elastic force without going through stepwise movement. An expanded portion of the slot engaging the slider assembly allows the blade to be received in a holder and ejected only when the slider assembly fully disengages from the expanded portion, thereby generating no sudden ejection of the blade. Additionally, a safety latch securely locks the blade when the blade is fully retracted. When the blade is fully extended, a stopper engages the slider assembly to prevent the blade from being retracted during cutting and stabbing. Accordingly, the assisted-opening knife addresses a solution to rapidly extend the blade for cutting and stabbing without compromising the safety considerations.

16 Claims, 8 Drawing Sheets

ASSISTED-OPENING KNIFE

BACKGROUND OF THE INVENTION

1. Field of the Invention

The present invention relates to a retractable knife, and more particularly to an assisted-opening knife using a spring to rapidly expand the blade and having a latch mechanism preventing the blade from being unlocked during cutting and stabbing.

2. Description of the Related Art

Retractable knives are very common tools for cutting things. As the retractable knives can be retracted and fully received in a holder when not in use, users can be prevented from being inadvertently wounded by the exposed blade. The popularity of the retractable knives is basically established on the safety protection.

With reference to FIG. 8, a conventional retractable knife has a holder 90, a blade 91 and a slider 92. The holder 90 takes a form of a flat and elongated box and has a top opening 93 (not shown), a front opening and a corrugated portion 94. The top opening 93 is formed through a top of the holder 90. The front opening takes a form of a slit, is formed through a front edge of the holder 90 and communicates with the top opening 93. The corrugated portion 94 is formed on a longitudinal inner side of the top opening 93 and has a plurality of peaks and valleys. The blade 91 is elongated and is slidably mounted in the holder 90 through the front opening. The slider 92 is fastened on a rear end of the blade 91 and has a stopper 95 mounted on one side of the slider 92 that is in parallel with the longitudinal inner side of the top opening. When the slider 92 is pushed and slidably moved to one of the valleys of the corrugated portion 94, the stopper 95 engages the valley, the blade 91 is temporarily locked, and a proper length of the blade 91 is extended or retracted.

Due to the engagement between the stopper 95 and the corrugated portion 94, the blade 91 can be held at an intended position in a stepwise manner which is not an efficient way to promptly move the blade 91. Besides, when the stopper 95 is facilitated to slide between the peaks and valleys of the corrugated portion 94, the stopper 95 does not tightly engage the corrugated portion 94. As a consequence, the stopper 95 easily disengages from a valley when the cutter knife is used to stab or cut things forcefully, and the blade 91 fails to be securely locked at an intended position for continuous cutting. Fingers of a user are easily pinched in the top opening 93 by the slider 92. To overcome the aforementioned drawbacks, the conventional retractable knife needs to be further developed.

SUMMARY OF THE INVENTION

An objective of the present invention is to provide an assisted-opening knife using a spring to rapidly expand the blade.

To achieve the foregoing objective, the assisted-opening knife has a holder, a blade, a blade carrier, a slider assembly, a stopper and a spring.

The holder is elongated and hollow, and has a top, a front portion, a right cover, a left cover, a slit and a front opening. The left cover is assembled with the right cover together. The slit is formed through the top of the holder. The front opening is formed through the front portion of the holder.

The blade has a right side and a bottom edge.

The blade carrier has a front portion, a rear portion, a bottom edge, a right side, an upper front portion, a slot and a recess. The slot is longitudinally formed through the blade carrier, and has a rear end and an expanded portion. The expanded portion is formed through the rear portion of the blade carrier and has a bevel surface and a horizontal surface. The bevel surface inclines downwardly from the rear portion of the blade carrier in a backward direction. The horizontal surface is formed between the bevel surface and the rear end of the slot. The recess is formed in and recessed from the bottom edge of the blade carrier and is parallel with the slot.

The slider assembly has a sliding seat, a sliding piece, a thumb stud, a fixing piece and a locking member. The sliding seat is mounted on the right side of the blade and having a right side. The sliding piece is slidably mounted within the slot of the blade carrier, mounted on the right side of the sliding seat, and has a right side. The thumb stud is mounted on the sliding seat and outside the holder. The fixing piece is mounted on the right side of the sliding piece and the right side of the blade carrier, and has a top rear corner and an unfilled corner. The unfilled corner is recessed downwardly from the top rear corner of the fixing piece. The locking member is mounted on a top of the fixing piece and has a rear bottom edge, a round hole, an oval hole and an engagement portion. The round hole is formed through the locking member. The oval hole is formed through the locking member and has a short axis being parallel with the slot of the blade carrier. The engagement portion is transversely formed on and protrudes to the left of the locking member from the rear bottom edge of the locking member, and is held in the expanded portion of the slot.

The stopper has a bottom edge, a rear end and a lower indentation. The rear end is pivotally mounted on the upper front portion of the blade carrier. The lower indentation is formed on and recessed from the bottom edge of the stopper, and engages the unfilled corner of the fixing piece.

The spring is mounted in the recess of the blade carrier with a rear end tied to the fixing piece and a front end tied to the front portion of the blade carrier. A tensile force of the spring generated when the blade is retracted forces the engagement portion of the locking member to be slid onto the horizontal surface of the expanded portion of the slot through the bevel surface.

When the assisted-opening knife is fully retracted, the engagement of the expanded portion of the slot and the engagement portion of the locking member holds the blade in a fully retracted state and the spring is expanded. After the engagement portion of the locking member is disengaged from the expanded portion of the slot, the blade is ejected by the elastic force of the spring to rapidly extend for cutting or stabbing. Additionally, the lower indentation of the stopper engages the unfilled corner of the fixing piece to ensure that the blade is not retracted during cutting or stabbing. Consequently, the assisted-opening knife can be rapidly expanded without sudden ejection of the blade and firmly operated during cutting and stabbing.

Other objectives, advantages and novel features of the invention will become more apparent from the following detailed description when taken in conjunction with the accompanying drawings.

DETAILED DESCRIPTION OF THE INVENTION

Figure 1:
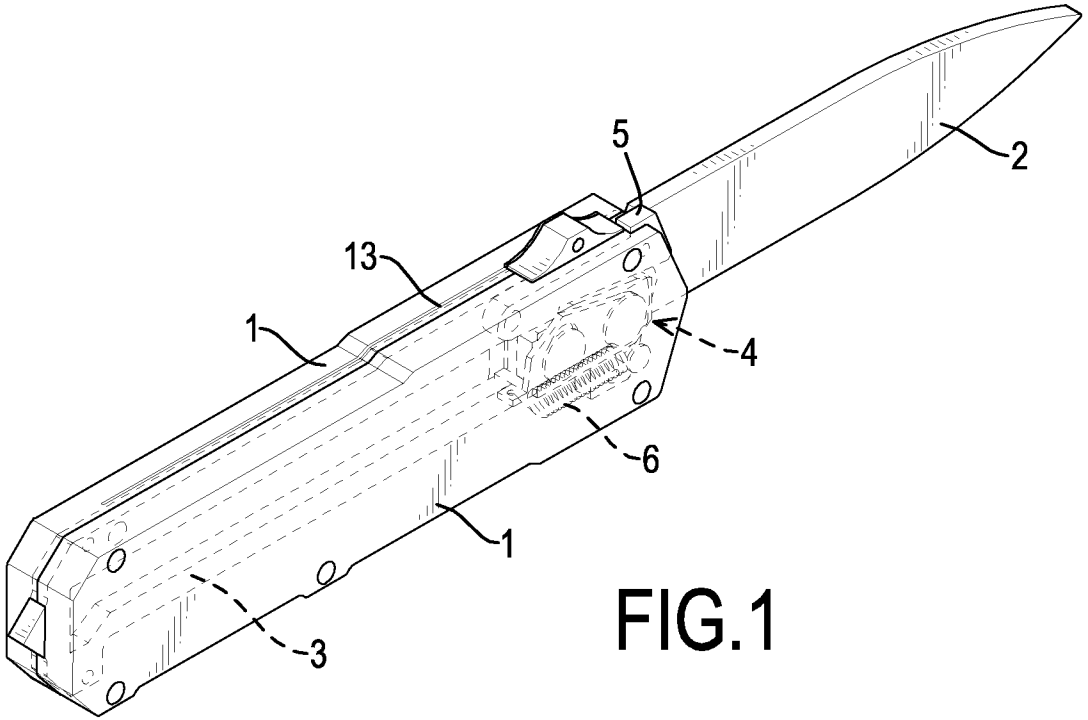
FIG. 1 is a perspective view of a first embodiment of an assisted-opening knife in accordance with the present invention.
Figure 2:
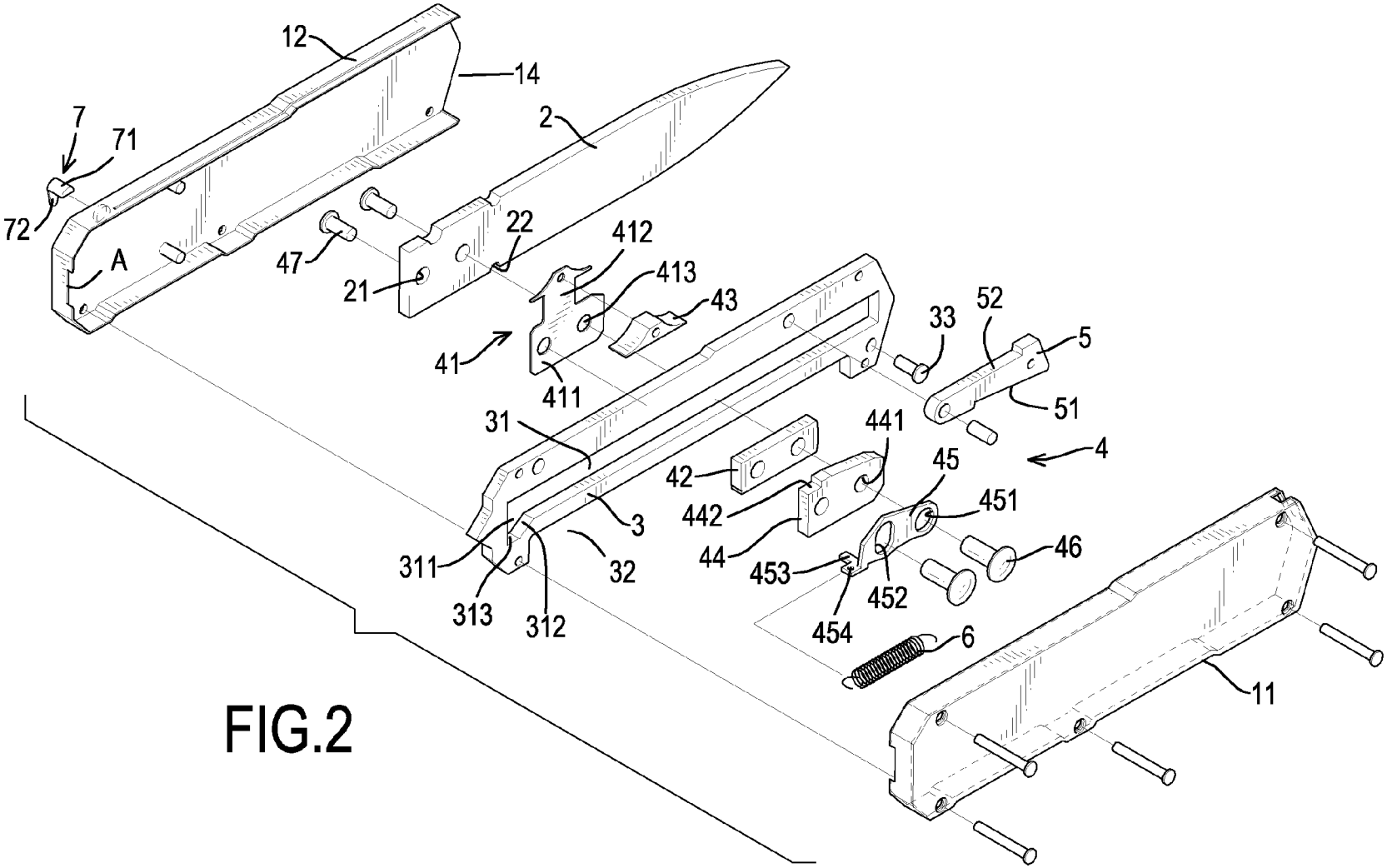
FIG. 2 is an exploded perspective view of the assisted-opening knife in FIG. 1.

With reference to FIGS. 1 to 2, a first embodiment of an assisted-opening knife in accordance with the present invention has a holder 1, a blade 2, a blade carrier 3, a slider assembly 4, a stopper 5, a spring 6 and a safety latch 7.

The holder 1 is elongated and hollow, and has a right cover 11, a left cover 12, a slit 13 and a front opening 14. The right cover 11 and the left cover 12 are assembled together. The slit 13 is longitudinally formed through a top of the holder 1. The front opening 14 is formed through a front portion of the holder 1. The blade 2 is received in the holder 1 and has two holes 21 and a locking notch 22. The locking notch 22 takes a form of a semicircle and is formed through a bottom edge of the blade 2. The two holes 21 are formed through a rear portion of the blade 2. The blade carrier 3 has a slot 31, a recess 32 and a pin 33. The slot 31 is longitudinally formed through the blade carrier 3 and has an expanded portion 311. The expanded portion 311 is formed through a rear portion of the blade carrier 3 and has a bevel surface 312 and a horizontal surface 313. The bevel surface 312 inclines downwardly from the rear portion of the blade carrier 3 in a backward direction. The horizontal surface 313 is formed between the bevel surface 312 and a rear end of the slot 31. The recess 32 is formed in and recessed from a bottom edge of the blade carrier 3 and is parallel with the slot 31. The pin 33 is mounted on a front portion on a right side of the blade carrier 3 and is in front of the recess 32 longitudinally.

The slider assembly 4 has a sliding seat 41, a sliding piece 42, a thumb stud 43, a fixing piece 44, a locking member 45 and two female bolts 46 and two male bolts 47. The sliding seat 41 is mounted between the blade 2 and the blade carrier 3, and has a longitudinal portion 411 and a transverse protrusion 412. The longitudinal portion 411 is mounted on the rear portion of the blade 2, and has two holes 413 formed through the longitudinal portion 411 and respectively aligning with the holes 21 of the blade 2. The transverse protrusion 412 is formed on and protrudes outwardly from a top edge of the longitudinal portion 411 and is mounted through the slit 13 of the holder 1. The sliding piece 42 is slidably mounted within the slot 31 of the blade carrier 3 and has two holes 421 formed through the sliding piece 42 and aligning with the holes 413 of the sliding seat 41. The thumb stud 43 is mounted on the transverse protrusion 412 of the sliding seat 41 and outside the holder 1. The fixing piece 44 is mounted on the sliding piece 42 on a side opposite to the sliding seat 41 and has two holes 441 and an unfilled corner 442. The holes 441 are formed through the fixing piece 44 and respectively align with the holes 421 of the sliding piece 42. The unfilled corner 442 is recessed from a top rear corner of the fixing piece 44. The locking member 45 is mounted on the fixing piece 44 on a side opposite to the sliding piece 42 and has a round hole 451, an oval hole 452, an engagement portion 453 and a spring hole 454. The round hole 451 and the oval hole 452 are formed through the locking member 45 and respectively align with the holes 441 of the fixing piece 44. A short axis of the oval hole is parallel with the slot 31 of the blade carrier 3. The round hole 451 may be longitudinally in front of the oval hole 452 or behind the oval hole 452. The engagement portion 453 is transversely formed on and protrudes from a rear bottom edge of the locking member 45, and is held on the horizontal surface 313 of the expanded portion 311 of the slot 31. The spring hole 454 is formed through a tab formed on and protruding backwardly from the rear bottom edge of the locking member 45. The slider assembly 4, the blade carrier 3 and the blade 2 are assembled together by the two female bolts 46 respectively and sequentially mounted through the round hole 451 and the oval hole 452 of the locking member 45, the two holes 441 of the fixing piece 44, the two holes 421 of the sliding piece 42, the slot 31 of the blade carrier 3, the two holes 413 of the sliding seat 41 and the two holes 21 of the blade 2, and by two male bolts 47 respectively screwed with the female bolts. After the slider assembly 4, the blade carrier 3 and the blade 2 are assembled together, the sliding piece 42 can be movable within the slot 31 of the blade carrier 3, and the locking member 45 can be slightly pivoted with respect to the round hole 451 by a difference between a length of the oval hole 452 along a long axis of the oval hole 452 and the shank diameter of a corresponding female bolt 46.

Figure 3B:
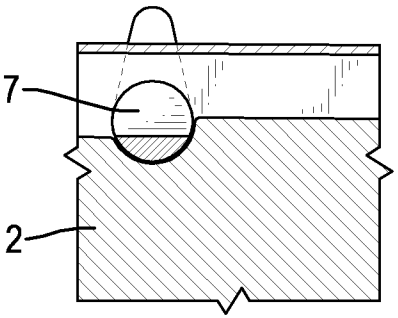
FIG. 3B is another top view in partial section of the safety latch of the assisted-opening knife in FIG. 1 when the safety latch is in an unlocked state.
Figure 3A:
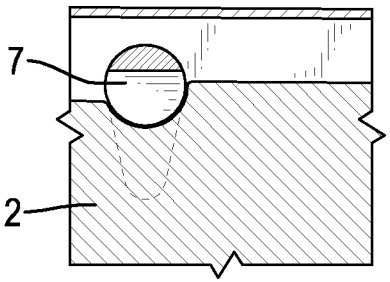
FIG. 3A is a top view in partial section of a safety latch of the assisted-opening knife in FIG. 1 when the safety latch is in a locked state.

The stopper 5 is elongated, and has a rear end pivotally mounted on an upper front portion of the blade carrier 3 and a front end protruding out from the front opening 14 of the holder 1. The stopper 5 further has a lower indentation 51. The lower indentation 51 is formed in and recessed from a bottom edge of the stopper 5, and serves to engage the unfilled corner 442 of the fixing piece 44 to stop the blade 2 and prevent the blade 2 from being pushed into the holder 1 during cutting and stabbing. A front end of the stopper is exposed from the slit 13 of the holder 1, is pivotally pressed upwardly to disengage the unfilled corner 442 of the fixing piece 44 from the lower indentation 51 of the stopper 5. The spring 6 has one end tied to the spring hole 454 of the fixing piece 453 and the other end tied to the pin 33 of the blade carrier 3. A tensile force of the spring 6 generated when the blade 2 is retracted forces the engagement portion 453 of the locking member 45 to be slid onto the horizontal surface 313 of the expanded portion 311 of the slot 31 through the bevel surface 312. The safety latch 7 is mounted through a left cover 12 of the holder 1 and selectively mounted in the locking notch 22 to engage and disengage from the locking notch 22 of the blade 2, and has a semi-cylindrical portion 71 and a handle 72. The semi-cylindrical portion 71 is mounted rotatably in the locking notch 22. The handle 72 is perpendicularly and integrally formed on and protrudes from one end of the semi-cylindrical portion 71. With reference to FIGS. 3A and 3B, the safety latch 7 is switched to a locked state by turning the handle 72 of the safety latch 7 and fully engaging the semi-cylindrical portion 71 in the locking notch 22 of the blade 2, and is switched to an unlocked state by turning the handle 72 and completely removing the semi-cylindrical portion 71 from the locking notch 22 of the blade 2.

Figure 4:
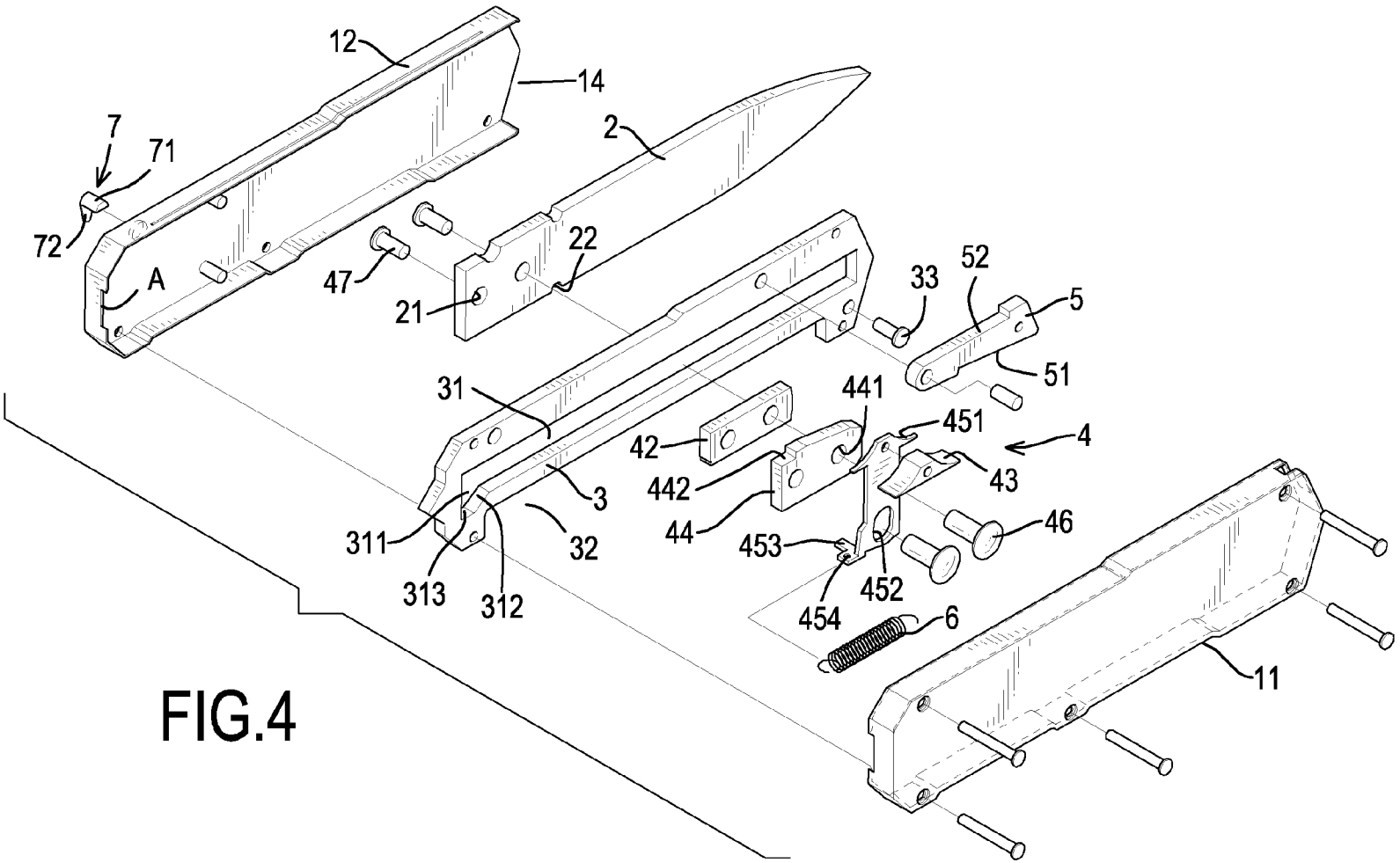
FIG. 4 is an exploded perspective view of a second embodiment of an assisted-opening knife in accordance with the present invention.

With reference to FIG. 4, a second embodiment in accordance with the present invention is similar to the first embodiment except the differences in the sliding seat 41 and the locking member 45. The sliding seat 41 is removed in the present embodiment. The locking member 45 is mounted on the fixing piece 44 on a side opposite to the sliding piece 42 and has an oval hole 452, a transverse protrusion 451, an engagement portion 453 and a spring hole 454. The oval hole 452 is formed through a lower portion of the locking member 45 and aligns with a corresponding hole 441 of the fixing piece 44. A short axis of the oval hole is parallel with the slot 31 of the blade carrier 3. The transverse protrusion 451 is formed on and protrudes upwardly from an upper portion of the locking member 55. The engagement portion 453 is transversely formed on and protrudes from a rear bottom edge of the locking member 45, and is held on the horizontal surface 313 of the expanded portion 311 of the slot 31. The spring hole 454 is formed through a tab formed on and protruding backwardly from the rear bottom edge of the locking member 45. The thumb stud 43 is mounted on the transverse protrusion 451 of the locking member 45 and outside the holder 1. The slider assembly 4, the blade carrier 3 and the blade 2 are assembled together by the two female bolts 46 respectively and sequentially mounted through the oval hole 452 of the locking member 45 and an empty space beside the oval hole 452, the two holes 441 of the fixing piece 44, the two holes 421 of the sliding piece 42, the slot 31 of the blade carrier 3, the two holes 413 of the sliding seat 41 and the two holes 21 of the blade 2, and by two male bolts 47 respectively screwed with the female bolts. After the slider assembly 4, the blade carrier 3 and the blade 2 are assembled together, the sliding piece 42 can be movable within the slot 31 of the blade carrier 3, and the locking member 45 can be slightly pivoted with respect to the oval hole 452 by a difference between a length of the oval hole 452 along a long axis of the oval hole 452 and the shank diameter of a corresponding female bolt 46.

Figure 5:
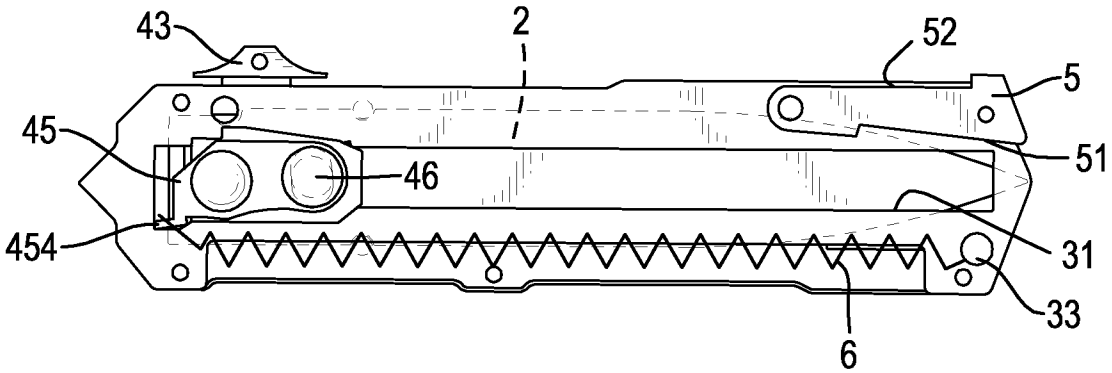
FIG. 5 is an operational top view of a third embodiment of an assisted-opening knife in accordance with the present invention when a blade is fully retracted.
Figure 6:
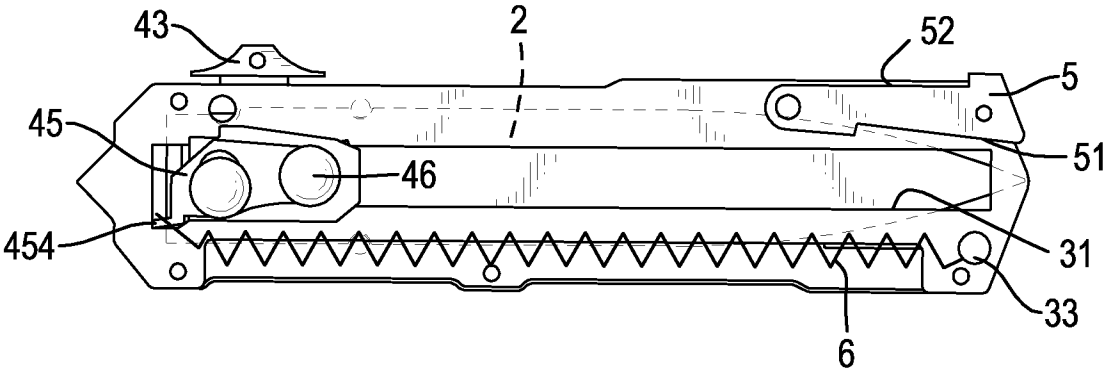
FIG. 6 is an operational top view of the assisted-opening knife in FIG. 1 when a blade is fully retracted.
Figure 7:
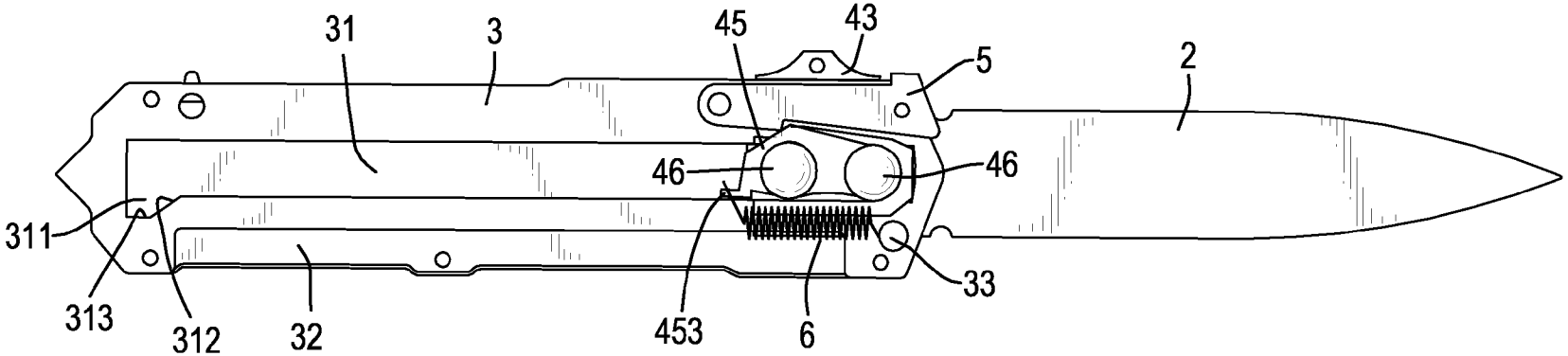
FIG. 7 is another operational top view of the assisted-opening knife in FIG. 1 when a blade is fully expanded.
Figure 7A:
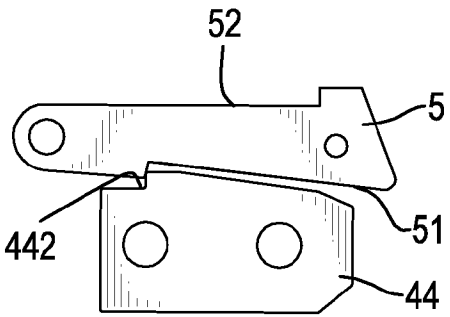
FIG. 7A is a partial top view of a slider assembly engaging a stopper of the assisted-opening knife in FIG. 4.
Figure 8:
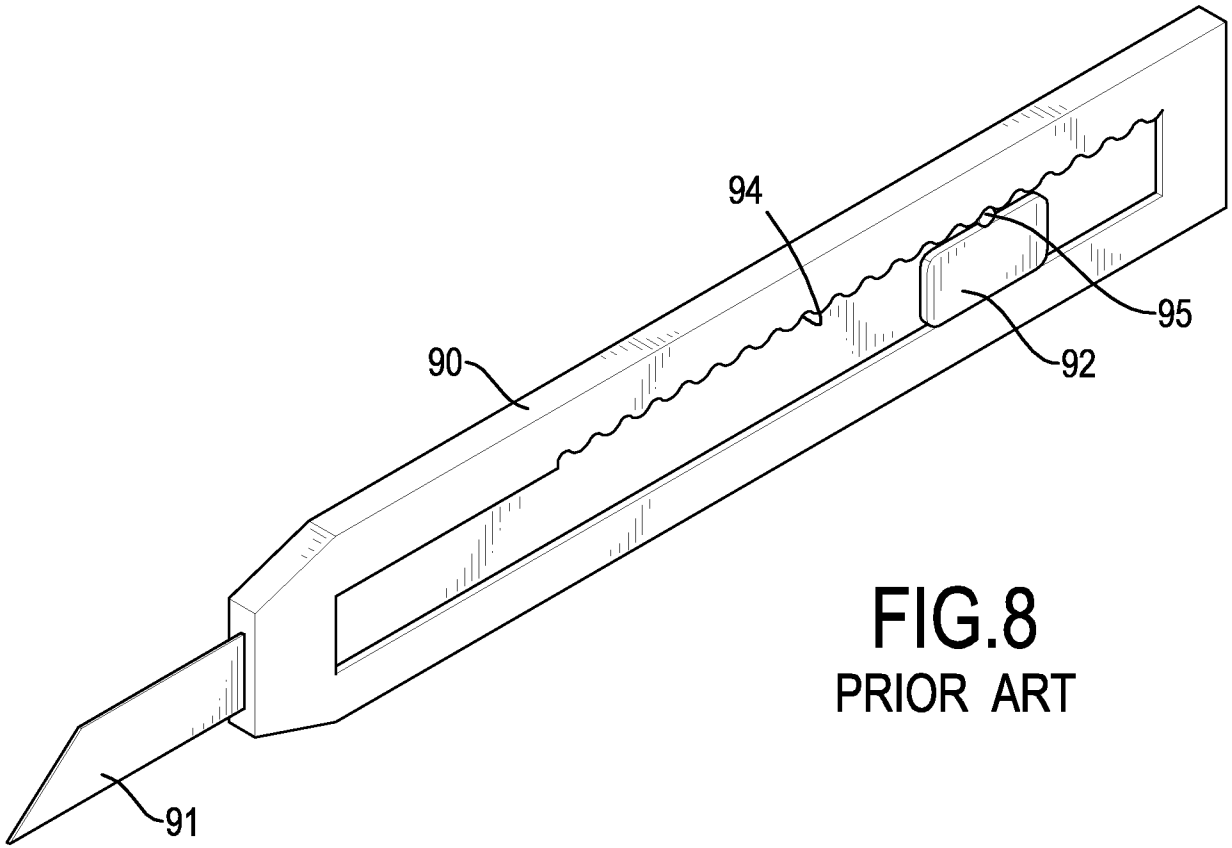
FIG.8 PRIOR ART
FIG. 8 is a perspective view of a conventional assisted-opening knife.

With reference to FIG. 6, the operation of the assisted-opening knife is described as follows. When the assisted-opening knife is fully retracted into the holder 1, the thumb stud 43 is stopped at a rear end of the slit 13 of the blade carrier 3, the locking member 45 is pivoted toward the bottom edge of the blade carrier 3, the engagement portion 453 of the locking member 45 is held in the expanded portion 311 of the slot 31 of the blade carrier 3, and the spring 6 is expanded. With reference to FIG. 5, the operation of retracting a third embodiment of an assisted-opening knife in accordance with the present invention is similar to that in FIG. 6 except that the oval hole 452 of the locking member 45 is located in front of the round hole 451. To safely maintain the fully retracted state of the assisted-opening knife and prevent the blade 2 from inadvertently extending out from the holder 1, the safety latch 7 is switched to a locked state. With reference to FIG. 7, when the assisted-opening knife is in use, the safety latch 7 is switched to an unlocked state. The thumb stud 43 is pushed to make a short movement and is released. Due to the elastic force of the spring 6, after departing from the horizontal surface 313 of the expanded portion 311, the engagement portion 453 climbs up the bevel surface 312, disengages from the expanded portion 311 of the slot 31, and becomes slidably movable along the slot 31. As a result, the blade 2 is assisted and promptly ejected by the spring 6 to extend out of the holder along the slot 31 of the blade carrier 3 until the sliding piece 42 reaches a front end of the slit 13. Meanwhile, the unfilled corner 442 of the fixing piece 44 engages the lower indentation 51 of the stopper 5 as shown in FIG. 7A to prevent the blade 2 from being retracted during cutting and stabbing. To retract the blade 2, a front portion of the stopper 5 is first pressed and pivotally moved upwardly to disengage the lower indentation 51 of the stopper 5 from the unfilled corner 442 of the fixing piece 44. Then, the thumb stud 43 is pushed to move backwardly and overcome the tensile force of the spring 6 until the locking member 45 is pivotally moved downwardly toward the recess 32 and the engagement portion 453 of the locking member 45 is slid through the bevel surface 312 of the expanded portion 311 of the slot 31 and is held on the horizontal surface 313 of the slot 31. The safety latch 7 can be switched in a locked state again to prevent the blade 2 from inadvertently extending out.

With the spring 6 tied to the pin 33 of the blade carrier 3 and the engagement portion 453 of the locking member 45, the blade 2 can be rapidly expanded out of the holder 1 by the elastic force of the spring 6 without having to go through stepwise movement required by the conventional retractable cutter knives. The existence of the expanded portion 311 of the slot 31 and the engagement portion 453 of the locking member 45 allows the blade 2 to be received in the holder 1 and ejected only when the engagement portion 453 fully disengages from the expanded portion 311. Such design generates no sudden ejection of the blade 2 for which users are normally unprepared. Additionally, the safety latch 7 provides a second means to securely lock the blade 2 when the blade 2 is fully retracted. When the blade 2 is fully expanded, the lower indentation 51 of the stopper 5 engages the unfilled corner 442 of the fixing piece 44 to prevent the blade 2 from being retracted during cutting and stabbing. Accordingly, the assisted-opening knife in accordance with the present invention addresses a solution to rapidly expand the blade 2 for cutting and stabbing without compromising the safety considerations.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. An assisted-opening knife comprising: a holder being elongated and hollow, and having a slit longitudinally formed on one side thereof and a front opening formed on a front end thereof; a blade slidably mounted in the holder for being expanded out of or retracted into the holder through the front opening; a blade carrier mounted in the holder and having a slot longitudinally formed thereon, wherein the slot includes an expanded portion formed adjacent to a rear end of the slot and the expanded portion includes a bevel surface inclining downwardly from the slot in a rearward direction and a horizontal surface formed between the bevel surface and the rear end of the slot; a slider assembly mounted in the holder and comprising: a sliding seat having a protrusion extended outside the holder through the slit and having one side fixed to one side of the blade; a sliding piece slidably mounted within the slot and having one side fixed to another side of the sliding seat; a thumb stud fixed to the protrusion; a fixing piece having one side fixed to another side of the sliding piece; and a locking member pivotally mounted on another side of the fixing piece and having an engagement portion transversely protruding from a rear bottom edge of the locking member and held in the expanded portion of the slot; a stopper pivotally mounted on the blade carrier at a position adjacent to the front opening for engaging with the fixing piece and preventing the blade from being pushed back into the holder when the blade is fully expanded out of the holder; and a spring having a rear end tied to the locking member and a front end tied to a front portion of the blade carrier; thereby, when the blade is fully retracted into the holder, a tensile force of the spring forces the engagement portion to be slid onto the horizontal surface of the expanded portion through the bevel surface.

2. The assisted-opening knife as claimed in claim 1, wherein the fixing piece further comprises an unfilled corner recessed downwardly from a top rear corner of the fixing piece, and the stopper further comprises a lower indentation formed on and recessed from the bottom edge of the stopper for engaging with the unfilled corner.

3. The assisted-opening knife as claimed in claim 1, further comprises a safety latch pivotally formed on the holder for selectively engaging or disengaging with a locking notch formed on an edge of the blade.

4. The assisted-opening knife as claimed in claim 2, further comprises a safety latch pivotally formed on the holder for selectively engaging or disengaging with a locking notch formed on an edge of the blade.

5. The assisted-opening knife as claimed in claim 3, wherein the safety latch comprises a semi-cylindrical portion mounted rotatably in the locking notch and a handle extended out of the handle.

6. The assisted-opening knife as claimed in claim 4, wherein the safety latch comprises a semi-cylindrical portion mounted rotatably in the locking notch and a handle extended out of the handle.

7. The assisted-opening knife as claimed in claim 5, wherein the blade carrier further comprises a pin mounted on the blade carrier at a position adjacent to the front end of the slot, the locking member further comprises a spring hole formed on a position adjacent to the engagement portion, and the rear end of the spring is tied to the spring hole and the front end of the spring is tied to the pin.

8. The assisted-opening knife as claimed in claim 6, wherein the blade carrier further comprises a pin mounted on the blade carrier at a position adjacent to the front end of the slot, the locking member further comprises a spring hole formed on a position adjacent to the engagement portion, and the rear end of the spring is tied to the spring hole and the front end of the spring is tied to the pin.

9. An assisted-opening knife comprising: a holder being elongated and hollow, and having a slit longitudinally formed on one side thereof and a front opening formed on a front end thereof; a blade slidably mounted in the holder for being expanded out of or retracted into the holder through the front opening; a blade carrier mounted in the holder and having a slot longitudinally formed thereon, wherein the slot includes an expanded portion formed adjacent to a rear end of the slot, and the expanded portion includes a bevel surface inclining downwardly from the slot in a rearward direction and a horizontal surface formed between the bevel surface and the rear end of the slot; a slider assembly mounted in the holder and comprising: a sliding piece slidably mounted within the slot and having one side fixed to one side of the blade; a fixing piece having one side fixed to another side of the sliding piece; a locking member pivotally mounted on another side of the fixing piece and having an engagement portion transversely protruding from a rear bottom edge of the locking member and held in the expanded portion of the slot, and having a protrusion extended outside the holder through the slit; and a thumb stud fixed to the protrusion; a stopper pivotally mounted on the blade carrier at a position adjacent to the front opening for engaging with the fixing piece and preventing the blade from being pushed back into the holder when the blade is fully expanded out of the holder; and a spring having a rear end tied to the locking member and a front end tied to a front portion of the blade carrier; thereby, when the blade is fully retracted into the holder, a tensile force of the spring forces the engagement portion to be slid onto the horizontal surface of the expanded portion through the bevel surface.

10. The assisted-opening knife as claimed in claim 9, wherein the fixing piece further comprises an unfilled corner recessed downwardly from a top rear corner of the fixing piece, and the stopper further comprises a lower indentation formed on and recessed from the bottom edge of the stopper for engaging with the unfilled corner.

11. The assisted-opening knife as claimed in claim 9, further comprises a safety latch pivotally formed on the holder for selectively engaging or disengaging with a locking notch formed on an edge of the blade.

12. The assisted-opening knife as claimed in claim 10, further comprises a safety latch pivotally formed on the holder for selectively engaging or disengaging with a locking notch formed on an edge of the blade.

13. The assisted-opening knife as claimed in claim 11, wherein the safety latch comprises a semi-cylindrical portion mounted rotatably in the locking notch and a handle extended out of the handle.

14. The assisted-opening knife as claimed in claim 12, wherein the safety latch comprises a semi-cylindrical portion mounted rotatably in the locking notch and a handle extended out of the handle.

15. The assisted-opening knife as claimed in claim 13, wherein the blade carrier further comprises a pin mounted on the blade carrier at a position adjacent to the front end of the slot, the locking member further comprises a spring hole formed on a position adjacent to the engagement portion, and the rear end of the spring is tied to the spring hole and the front end of the spring is tied to the pin.

16. The assisted-opening knife as claimed in claim 14, wherein the blade carrier further comprises a pin mounted on the blade carrier at a position adjacent to the front end of the slot, the locking member further comprises a spring hole formed on a position adjacent to the engagement portion, and the rear end of the spring is tied to the spring hole at the front end of the spring is tied to the pin.

* * * * *